US006082383A

United States Patent [19]

Wilson

[11] Patent Number: 6,082,383

[45] Date of Patent: Jul. 4, 2000

[54] UMBRELLA WITH ACTUATOR SLEEVE FOR MANUAL AND AUTOMATIC OPERATION

[76] Inventor: Robert Joe Wilson, 136 Woodhaven Cir., Athens, Ga. 30606

[21] Appl. No.: 09/123,003

[22] Filed: Jul. 28, 1998

[51] Int. Cl.[7] ..... C23G 1/02

[52] U.S. Cl. ..... 135/41; 135/20.3; 135/25.1; 135/28; 135/39

[58] Field of Search ..... 135/28, 39, 38, 135/41, 25.1, 20.3

[56] References Cited

U.S. PATENT DOCUMENTS

| | | | |
|---|---|---|---|
| 1,180,145 | 4/1916 | Hart . | |
| 1,273,861 | 7/1918 | Howard . | |
| 2,822,815 | 2/1958 | Bremshey . | |
| 5,046,518 | 9/1991 | Chang | 135/37 |
| 5,069,237 | 12/1991 | Flanagan | 135/19.5 |
| 5,184,639 | 2/1993 | Lee | 135/28 |
| 5,253,666 | 10/1993 | Huang | 135/28 |
| 5,284,171 | 2/1994 | Liu | 135/20.3 |
| 5,329,953 | 7/1994 | Becher | 135/31 |

*Primary Examiner*—Carl D. Friedman
*Assistant Examiner*—Yvonne M. Horton
*Attorney, Agent, or Firm*—John P. Halvonik

[57] ABSTRACT

An operating mechanism for "patio type" umbrellas uses an actuator sleeve in order to open and close the canopy. The sleeve is in connection an inner rod on the inside of the main shaft that in turn is used to open and close the ribs that support the canopy of the umbrella. Movement of the actuator sleeve upward will move the inner rod upward as well as pull the ribs downward so as to close the canopy. Movement of the actuator sleeve downward will pull the ribs away from the central shaft and hence open the canopy. Because of the short length of the ribs combined with the weight of the canopy itself, it is believed that this makes such large patio type umbrellas easier to open and close using this sleeve actuator mechanism.

2 Claims, 1 Drawing Sheet

UMBRELLA WITH ACTUATOR SLEEVE FOR MANUAL AND AUTOMATIC OPERATION

FIELD AND BACKGROUND OF THE INVENTION

The invention relates to the field of umbrellas and, in particular, to those umbrellas used to cover tables and the like in outdoor settings. Typically such larger umbrellas are used to cover those tables in patios for restaurants and the like. Such umbrellas are typically significantly larger than ordinary hand held umbrellas and greater force is needed to operate them. The actuator sleeve shown and described herein is believed to work well in such applications that call for large umbrella canopies.

Because the distance the spokes that support the ribs of the canopy have been reduced in length and because the spokes connect to the ribs closer to the central "hub" of ribs, the spokes do not have to travel as far in order to open and close the canopy. As the actuator sleeve is in connection with the "hub" this means that the sleeve does not have to travel as far in order to open and close the canopy. There is greater leverage created on the ribs by this decreased distance and this requires greater force to slide the sleeve, however as this work can be done electrically the benefit of the short travel length (of the sleeve) allows the actuating mechanism to be used in such electrical applications without having a long travel length which would require longer movements of the actuator sleeve and would require greater vertical height above the canopy in order to permit this arrangement. The same benefits would apply to manual operation in that less vertical clearance above the canopy would be required.

It is believed that the invention will find its greatest use in opening and closing "patio" type umbrellas which are very popular in restaurants that feature and outdoor settings. Such umbrellas have large canopies that are typically much larger than ordinary hand held umbrellas. Such patio umbrellas of course have larger components: longer length support ribs, larger canopy, larger shafts, etc. Most such canopies use a manual crank in order to open and close the canopy. This requires a greater force for the user to turn the crank and also places additional strain on the cables associated with the mechanism. As the crank turns, the cord or cable is wound upon a drum or similar mechanism, this means that as the cable is wound, the radius of the cable on the drum increases and the drum becomes harder to turn near the end of the cranking. This may result in damage or breaking the cable and also requires greater force for the one using the crank. There is also the possibility of binding the cable when using a crank mechanism.

The inner rod of the invention may be adapted for electronic control, say by a electric motor housed in the umbrella that can operate the inner rod electrically.

DESCRIPTION OF THE PRIOR ART

While there are umbrellas in the prior art (e.g. Wu; U.S. Pat. No: 5,515,878) that show the use of sleeve members that slide along the main shaft and form part of the operating system that opens and closes the ribs that support the canopy. None of these type are used in patio umbrellas to the inventor's knowledge. Most such patio type umbrellas use a manual crank in order to open and close the canopy.

SUMMARY OF THE INVENTION

An operating mechanism for "patio type" umbrellas that uses an actuator sleeve that slides along the main shaft of the umbrella and is in connection with an inner rod in order to open and close the canopy. The main shaft is hollow and has a main shaft that has the actuator sleeve on the outside surface and an inner rod on the inside of the main shaft. The inner rod is connected to the ribs that support the canopy at a "hub" or central section or top section. Movement of the actuator sleeve upward will move the inner rod upward as well as pull the ribs downward so as to close the canopy.

Movement of the actuator sleeve downward will pull the ribs away from the central shaft and hence open the canopy. Both of these movements are made easier by spokes of relatively short length that connect the ribs to the main shaft and pivot throughout the movement. Because of the short length of the ribs combined with the weight of the canopy itself, it is believed that this makes such large patio type umbrellas easier to open and close using this sleeve mechanism.

It is an object of the invention to provide a manual or electric actuator means for larger umbrellas used in patio and other outdoor settings that has a reduced length of travel for the actuating parts in order to reduce the amount of vertical clearance needed for such applications.

Another object of the invention is to provide an actuating means for umbrellas having spokes of reduced length in connection with support ribs in order to make it easier to open and close the umbrellas and require less force on the part of the user to do such opening and closing.

It is an object of the invention to provide a manual or electric actuator means for larger umbrellas used in patio and other outdoor settings in order to eliminate the need for manual cranks in such applications.

Other objectives of the invention will become apparent to those skilled in the art once the invention has been shown and described.

DESCRIPTION OF THE PREFERRED EMBODIMENT

Figures 1, 2, 3:
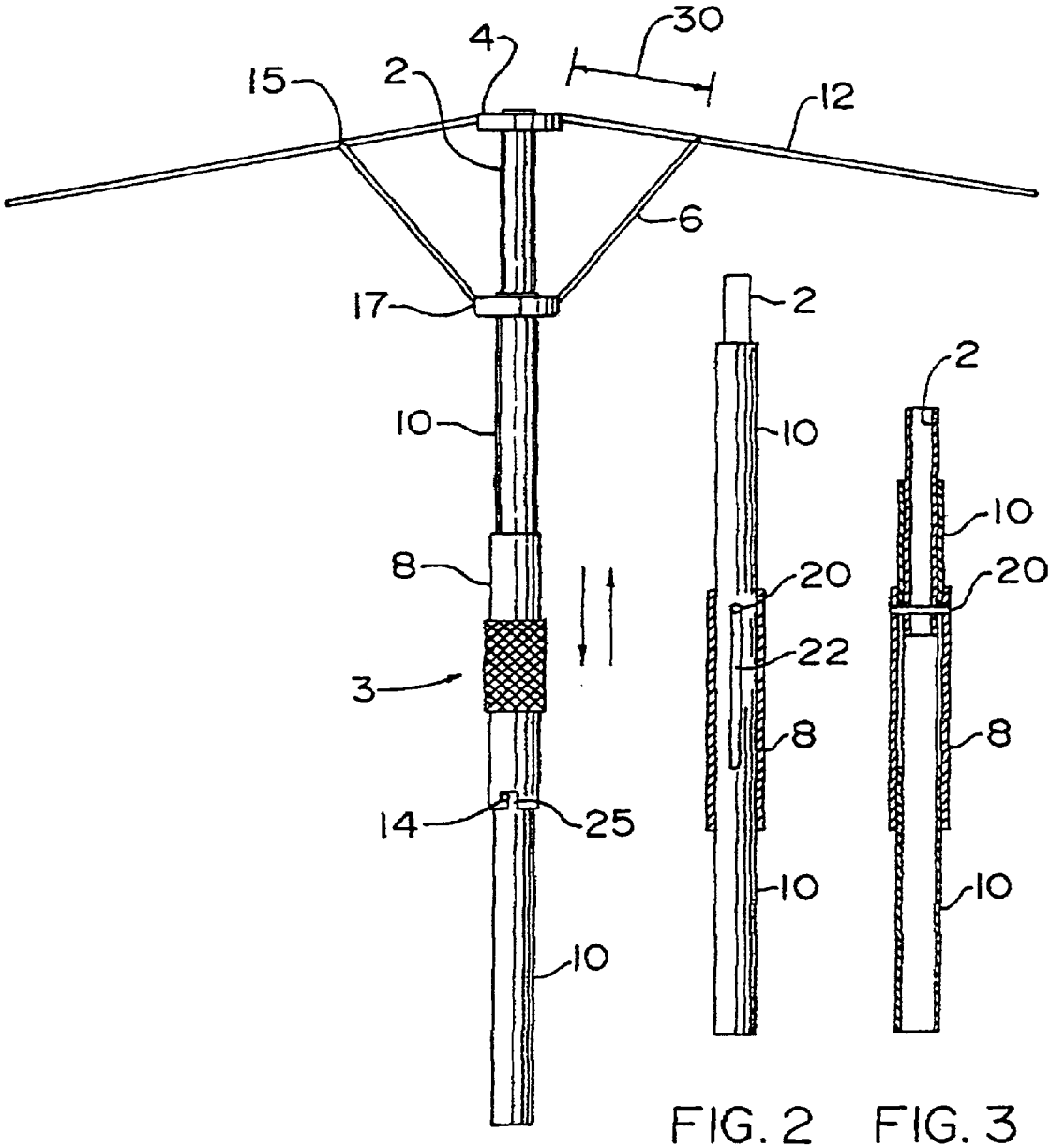
FIG. 1 overall construction of working units.
FIG. 2 cut away view when the canopy is closed.
FIG. 3 another cut away view when closed.

The overall construction of the actuator sleeve and mechanism is shown in FIG. 1. The inner shaft 2 slides inside the main shaft 10. The inner shaft has at least one extension piece 20 (shown in FIG. 3) that connects the inner shaft with the actuator sleeve 8 through a slot 22 in the main shaft 10. Movement up or down of the actuator sleeve 8 moves the inner rod in the same direction as the sleeve.

The top of the inner rod 4 may be referred to as a "hub" or central portion or top portion. It is in connection with a series of ribs 12 that support the canopy. (Canopy not shown but would be in connection with the ribs in manner similar to most umbrellas). Pivoting spokes 6 further support the ribs. The spokes are connected at point 15 to the ribs and at point 17 on the main shaft. Both of these connections allow the spokes to pivot in relation to the shaft and the ribs.

With the canopy in an open position (deployed as in FIG. 1) the ribs are in an outward orientation, and parallel or almost parallel to the horizon. This orientation is shown in FIG. 1. When it is desired to close the umbrella, the inner shaft 2 is moved upward (by upward movement of the sleeve) and this pushes the ribs down and they will collapse against the main shaft 10. The main shaft does not move, so the spokes 6 will pivot so as to become parallel to the main shaft. The ribs will also become parallel, or nearly so with the main shaft.

The actuator sleeve can be locked into position by means of a manual locking mechanism, shown as 14 in FIG. 1. 14 is an extension on the main shaft and there is a slot 25 on the sleeve that will interact with it. When the canopy is closed, the sleeve is in its highest upward position. To open, the sleeve is moved downward and as it reaches its bottom position, the sleeve will come in contact with the extension 14. The position of the extension piece 14 on the main shaft 10 can be determined through trial and error but it should be so that the slot will interact with it when the sleeve reaches the bottom of travel. This can be determined by observing when the downward movement of the sleeve has moved the ribs flush against the main shaft. At that point, the actuator sleeve cannot move anymore and the extension 14 should be at that point where it will interact with the sleeve in its furthest downward position.

When the sleeve is in the furthest downward position, the extension will be so oriented so that the sleeve can be rotated so that the slot 25 in the sleeve will "lock" the extension piece 14 into the slot. This will prevent the sleeve from being moved upward if for instance a wind should catch the canopy and force it downward. The lock will thus prevent the wind from inadvertently blowing the canopy closed. Rotating the sleeve the other way will, of course, unlock the sleeve in order to raise the sleeve upward when the canopy is desired to be closed. A similar extension piece and slot (not shown) may be used to lock the sleeve in its furthest upward position (when the canopy is closed). In that case, the slot would be at the top of the sleeve and the extension piece would be positioned so as to be in connection with the upper slot when the sleeve is in its furthest upward position.

It is thought that the weight of the canopy can be balanced against that of the inner rod so as to aid in closing and opening the canopy once the sleeve is unlocked. The weight of the canopy can be so balanced so that a slight movement upward of the inner rod will tend to close the canopy as the weight of the canopy then tends to close itself. And, when the rod moves downward the weight of the canopy will help to pull the inner rods upward at the same time. Because the spokes 6 are attached so close to the hub (preferably about 12" for normal size canopies, see distance 30) a portion of the weight of the canopy is outside the point 15 and hence will tend to balance against the weight of the canopy inside of point 15 plus the weight of the inner rod. When opening the umbrella, the weight of the rod will tend to force it downward and tend to open the ribs outward to deploy the canopy.

This point 15 is chosen at a distance from the hub 4 so that the resulting construction will allow that portion of the weight of the canopy to balance that of the inner rod and, hence, the canopy will be easy to open and close because the weight of the canopy as it interacts with the inner rod will tend to neither force the rod up or down. The canopy, in a sense, balances the weight of the inner rod to make it easy to open and close the umbrella. The weight of the canopy and inner rod are, therefore, balanced by the choice of distance 30 so that minimum physical effort is required to open and close the canopy. The outdoor patio-type umbrellas preferred for this application of the invention are usually about 7' in diameter and so the distance of 12" designated by numeral 30 is appropriate for these sizes of umbrellas.

It is preferred that the length of the spokes be about 8" when used with this mechanism and with the typical sized patio umbrella canopies. This represents a decrease in length for similar spokes that are used with the common crank type of patio umbrella. They should be connected to the ribs at a point about 12" from the central hub. This distance shown by numeral 30. This also represents a decrease over similar ribs used in crank type umbrellas. The lengths of course, will vary with different sized canopies but these lengths can be determined by trial and error so that weight of the canopy outside of point 15 will tend to counterbalance the weight of the rod 2 and inner portions of the canopy. When the appropriate distances (6 and 30) are selected then these forces (outer part of canopy and the rod) can be counter balanced so that only slight force in either direction can open or close the canopy.

Decreasing spoke length is thought to make the umbrella easier to open and close than state of the art crank types of patio umbrellas because in the crank types, these spokes are longer which increases the distance that the crank and cable will have to move in order to close/open the canopy. Because the distance that must be moved by the ribs is longer this in turn requires more torque on the drum that is reeling the cable in. During the cranking process the angle of the ribs and canopy will increase and hence the torque required of the person winding the drum will become greater as the winding process continues.

The applicant's invention is believed to eliminate the strain placed on cables by the typical cranking mechanisms and eliminate these problems of greater force required, greater chance of breaking or damaging the cable as well as eliminating the problem of the cable becoming jammed altogether.

What is claimed is:

1. An improved patio umbrella comprising: a main shaft having an outer portion a hollow center, an inner rod having a top and a bottom portion and of size able to fit inside said hollow center and fixed for sliding up and down within said hollow portion, an actuator sleeve arranged around said outer portion of said main shaft and fixed for up and down movement around said main shaft, said actuator sleeve in connection with said inner rod through a connecting means arranged within said hollow portion, a plurality of ribs in connection with a canopy, said canopy being of about circular shape and having a canopy diameter, said ribs joined to a hub and fixed for pivotal movement in relation to said hub, said hub in connection with said top portion of said inner rod, a plurality of spokes having one end in pivotal connection with each of said ribs and the other end in pivotal connection with said main shaft; each of said spokes is in connection with each of said ribs at a pivot point on said rib so that the distance from said hub to each said pivot point is about 1/7 that of said diameter of said canopy, said spokes having a length about 2/3 that of said distance from said hub to said pivot point.

2. The apparatus of claim 1 wherein said canopy is about 7 feet in diameter and said distance from said hub to each said pivot point is about 1 foot in length and said spokes are about 8" in length.

* * * * *